US010837701B2

(12) United States Patent
Türkyilmaz et al.

(10) Patent No.: US 10,837,701 B2
(45) Date of Patent: Nov. 17, 2020

(54) DRIER WITH SOLAR RADIATION SIMULATION

(71) Applicants: Murat Türkyilmaz, Edirne/Merkez (TR); Artun Ağ, Golcuk/Kocaeli (TR)

(72) Inventors: Murat Türkyilmaz, Edirne/Merkez (TR); Artun Ağ, Golcuk/Kocaeli (TR)

(73) Assignee: Visys Makine Sanayi ve Dis Ticaret Limited Sirketi, Beylikduzu (TR)

( * ) Notice: Subject to any disclaimer, the term of this patent is extended or adjusted under 35 U.S.C. 154(b) by 0 days.

(21) Appl. No.: 15/773,480

(22) PCT Filed: Nov. 3, 2016

(86) PCT No.: PCT/TR2016/000159
§ 371 (c)(1),
(2) Date: May 3, 2018

(87) PCT Pub. No.: WO2017/078639
PCT Pub. Date: May 11, 2017

(65) Prior Publication Data

US 2018/0320966 A1 Nov. 8, 2018

(30) Foreign Application Priority Data

Nov. 5, 2015 (TR) ..... a 2015 13872

(51) Int. Cl.

| | |
|---|---|
| ***F26B 3/30*** | (2006.01) |
| ***F26B 3/347*** | (2006.01) |
| ***F26B 9/06*** | (2006.01) |
| ***F26B 3/20*** | (2006.01) |
| ***F26B 3/28*** | (2006.01) |

(52) U.S. Cl.
CPC ..... *F26B 3/30* (2013.01); *F26B 3/20* (2013.01); *F26B 3/286* (2013.01); *F26B 3/347* (2013.01); *F26B 9/066* (2013.01)

(58) Field of Classification Search
CPC .... F26B 3/30; F26B 3/20; F26B 3/286; F26B 3/347; F26B 9/066
USPC ..... 34/266
See application file for complete search history.

(56) References Cited

U.S. PATENT DOCUMENTS

| | | | | |
|---|---|---|---|---|
| 1,426,816 A * | 8/1922 | Casey | F26B 9/066 34/191 |
| 3,271,874 A * | 9/1966 | Oppenheimer | F26B 5/06 34/292 |
| 3,273,258 A * | 9/1966 | Liebert | A23B 5/022 34/62 |
| 6,233,841 B1 * | 5/2001 | Beach | A23L 3/54 34/203 |

(Continued)

FOREIGN PATENT DOCUMENTS

WO WO-2017078639 A1 * 5/2017 ..... F26B 3/30

*Primary Examiner* — Stephen M Gravini
(74) *Attorney, Agent, or Firm* — Adler, Pollock & Sheehan P.C.

(57) ABSTRACT

The present invention is a portable drier with solar simulator that can be used by small or medium scale farmers, which provides drying of the fruits and vegetables in general in the agriculture sector, in an organic manner through natural methods, which benefits from IR and UV rays during this process, and as a result, creates a difference in the extension of their shelf life, and which, in order to protect human health, minimizes the chemical remnants that cause diseases.

20 Claims, 2 Drawing Sheets

(56) References Cited

U.S. PATENT DOCUMENTS

Figure 1:
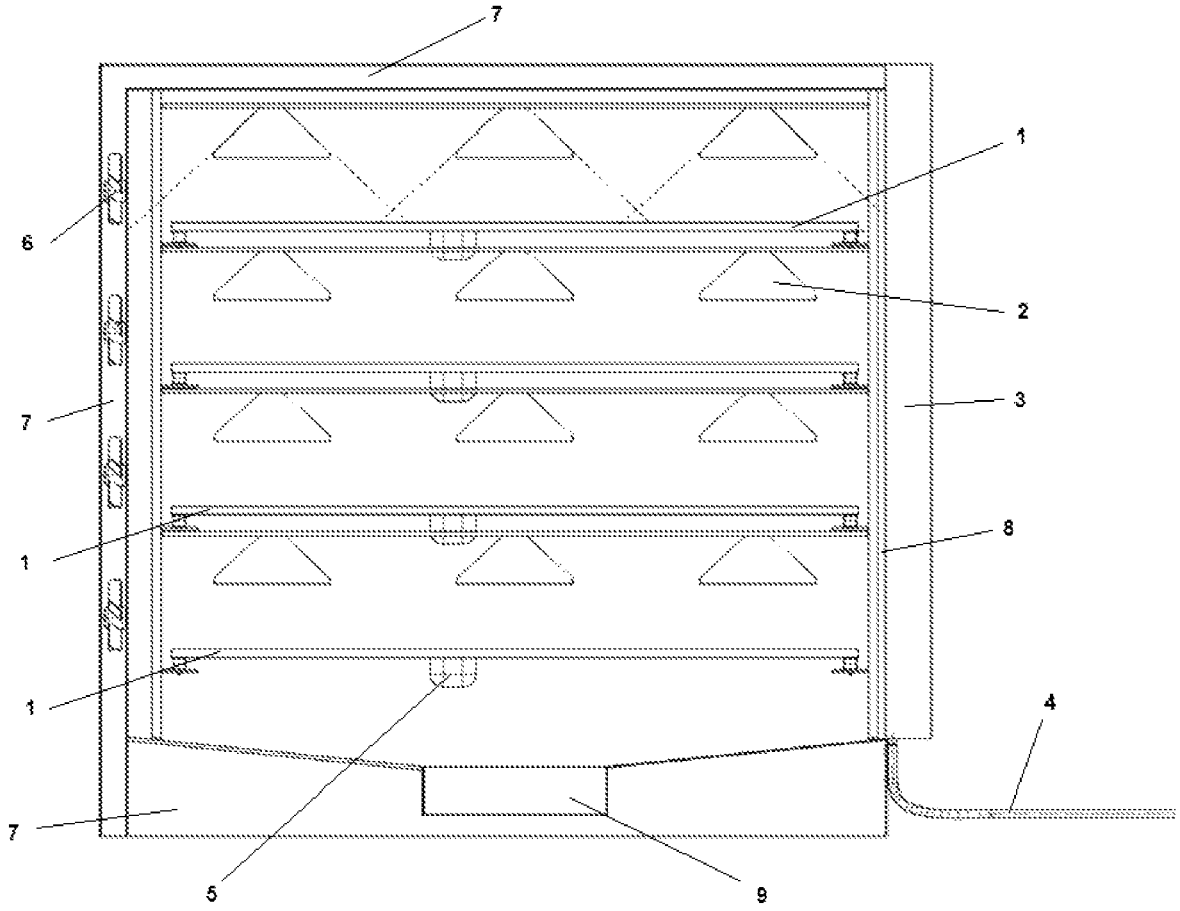

| | | | | |
|---|---|---|---|---|
| 6,941,673 | B1 * | 9/2005 | Chen | F26B 3/286 34/203 |
| 6,990,748 | B2 * | 1/2006 | Magoon | F26B 3/26 34/197 |
| 7,665,226 | B2 * | 2/2010 | Tsuruta | A23B 4/015 219/688 |
| 9,250,015 | B2 * | 2/2016 | Weir | F26B 3/286 |
| 9,301,535 | B1 * | 4/2016 | Bearg | F26B 25/063 |
| 9,863,699 | B2 * | 1/2018 | Corbin, III | F26B 5/06 |
| 2018/0320966 | A1 * | 11/2018 | Turkyilmaz | F26B 3/30 |

* cited by examiner

DRIER WITH SOLAR RADIATION SIMULATION

CROSS REFERENCE TO RELATED APPLICATIONS

This application is a national phase filing under 35 U.S.C. § 371 of International Application No. PCT/TR2016/000159 filed Nov. 3, 2016, which claims priority from Turkey application number TR2015/13872, filed Nov. 5, 2015, the entire contents of which are hereby incorporated by reference herein.

TECHNICAL FIELD

The present invention is related to a drier which provides dried products with longer shelf life and higher nutritious values, by consuming less energy during the drying process of the products such as fruits and vegetables in the food industry and which contains a solar simulator and uses UV and IR rays in this simulator.

STATE OF THE ART

Drying is the process of evaporation and removal of the water content contained by any substance. During the drying process, the water content inside the substance first moves towards the surface of the substance by liquid or vapor diffusion and then to the air by evaporation from the surface There are two process steps in drying process:

- Heat transmission in order to provide the required latent heat of evaporation
- Movement of the water content or water vapor in the foodstuff and then its removal from the foodstuff and accordingly, separation of the water content from the foodstuff.

Either solar energy (natural drying) or heated air (artificial drying) is used as the source of energy required for evaporation of the water content. Drying under the sun, or drying by using the solar energy is used commonly today including the developed countries. Drying the foodstuff by heated air is carried out since the II. World War Years. Artificial drying has some advantages when compared to the natural drying. In the natural drying; drying process is carried out outdoors by laying the product on the ground or on an appropriate platform. In the natural drying; drying conditions cannot be controlled. There is a difference of night-day and the drying conditions may change day by day. In the natural drying; the quality varies in the products obtained and a standard quality cannot be achieved. Moreover, drying speed is quite low, achieving hygienic conditions is quite difficult and loss of product during drying is quite much. In the drying process carried out by natural methods. Large spaces are required during the drying process by natural methods. Labor is quite high.

In artificial drying however, drying temperature and duration can be controlled, the product quality is preserved more since it is dried in closed systems, hygienic conditions can be provided during drying and more products can be dried in shorter time. In artificial drying; there is less product loss during drying.

The purpose of the drying process; is to extend the life of the foodstuff. As the water content in the foodstuff gets lesser, the speed of the spoilage reactions gets slower and this is minimized under a certain level of water content. Following the drying; transportation and storage is facilitated since the volume and weight of the foodstuff is reduced. Microorganisms causing the spoilage and rotting of the foodstuff cannot develop and reproduce in the absence of water content in the foodstuff. Many of the enzymes which can cause undesired changes in the chemical combination of the foodstuff, cannot be active in case there is no water content within the structure of the foodstuff. The speed of the other spoilage reactions such as enzymatic, non-enzymatic, oxidation reactions is also reduced.

In the state of the art, there are many different types of driers used in the food industry. Drying principles can be applied to any type of drier. Operation principles of some of the driers are provided below:

- Tray driers: Foodstuff is generally laid on the trays of the drier as a very fine layer. Heating is provided by heated air current sweeping over the trays, in other words, by internal circulation or by the heated plates on which the trays shall be placed or by conduction from the racks or by radiation from the heated surfaces. These types of driers are also heated by heated air current which also removes the vapor created. Tray driers are generally in the structure of a chamber where the walls are covered by an appropriate insulation material. There are racks in the chamber where the trays are placed. The foodstuffs to be subjected to drying process are laid on the trays which shall be taken into the chamber by the trolleys with racks. Heating of the air is realized in the drier in these types of driers. Heated air is not supplied from outside. The speed of the air flow provided by a fan goes beyond 100 m/min in order to enable sufficient air circulation within the chamber. Tray driers can dry 1 to 20 tons of raw materials (fruits and vegetables) per day.
- Drum Driers: In the drum driers; viscous foodstuff is spread over a metallic cylinder which is heated from inside and rotates slowly. While the cylinder rotates at specific speed, the foodstuff on the surface of the cylinder dries as based on the heat coming from inside. When the drying process is completed; the dried foodstuff is scraped off from the surface of the cylinder by a special scraper. The cylinders of these driers have a smooth surface and are produced of cast iron. In double cylinder driers, the cylinders rotate in opposite directions. Melted viscous substance to be dried is poured in the V-shaped gap between the cylinders. In large driers, there are moving feed pipes so that the melted substance is evenly spread on the cylinder surface and there are shakers in order to provide homogeneity. Cylinder driers are used in the production of milk powder, instant soup, some baby food and potato powder.
- Fluid bed driers: In fluid bed driers; the foodstuff to be dried is subjected to drying process by suspending against gravity. The suspended foodstuff is dried in an upward flowing heated airflow. The foodstuff can also be moved along the drier and dried by a horizontal airflow. The heat is usually transferred to the foodstuff by convection. Fluid bed driers are used in drying the foodstuff such as peas, green beans, carrots, onions, potatoes, meat, coffee, cocoa, salt, sugar etc.
- Pneumatic driers: In pneumatic driers; the foodstuff to be dried is conveyed rapidly in air flow. The drying is provided by the heated air. Usually there is a classifying system in the drier. With the help of this system; dried foodstuff is separated and removed from the drier, and the foodstuff which is not dried yet is recirculated into the system for further drying.
- Rotary driers: In the rotary driers, the foodstuff is placed in a cylinder. While the foodstuff is traveled in the cylinder, the heating process is realized by the heated air flow through the cylinder or by conduction of heat from the cylinder walls. In some cylinder driers, the cylinder itself rotates, and in some, the cylinder is stationary and a paddle or an endless screw rotates within the cylinder and conveys the foodstuff through.

Spray driers: In the spray driers; the foodstuff in liquid form or in very fine solid particles is sprayed into the heated air. In spray driers, drying process is completed very rapidly. Due to this, spray drying is appropriate for the foodstuff which can be damaged by exposure to heat for a long period of time. Spray driers are used for the production of milk powder, whey powder, dry baby food produced of milk, butter and cheese, tea extract, coffee extract, fruit and vegetable powders, meat extract and yeast extract.

Freeze driers: In freeze driers; the foodstuff to be dried is placed on racks in a chamber that is under high vacuum. In most cases, the foodstuff is in a frozen state before being placed in the drier. There is only 0.1-2.0 mm/Hg of pressure in the freeze driers. The vapor created by sublimation is removed from the foodstuff by a vacuum pump and it is condensed. In the "accelerated freeze drying" however, the heat is transferred to the foodstuff by conduction. In this process, thin metal sheets are placed in between the foodstuff and the heated plates in order to accelerate the heat transfer and removal of the water vapor created. A cooler can be used in order to condense the vapor created from the foodstuff by sublimation. Freeze driers are very expensive. They are used in drying some fruits with small particles such as wild strawberry, grapes or in some vegetables and in the drying coffee extract, tea extract and the seafood such as shrimps.

Tunnel driers: Tunnel driers are systems that operate continuously. It would be appropriate to use the tunnel driers if the volume of the raw material to be dried is much, the general structure is homogenous and the distribution of the water content in it is homogenous. The raw materials which are required to be dried slowly are dried in the tunnel driers. Tunnel driers can be considered as the developed form of the tray driers. In the tunnel driers, the trays are placed on trolleys. The foodstuff is laid on the trays. Heating process and removal of the vapor is carried out in the tunnels. Usually air is used as the heating source. The foodstuff to be dried is moved with the air flow in the drier as parallel or in the opposite direction. Air flow can also be directed as vertical to the way of the trolleys. This way; different heating units can be used for the different parts of the mentioned tunnel. The tunnel dimensions can be for example, as 2×2×24 m. Tunnel driers can be categorized as parallel flow tunnel driers, counter flow tunnel driers, center exhaust tunnel driers and cross flow tunnel driers. Tunnel driers are used in drying the fruits and vegetables.

The Drier described in the document no KR101248473 with the title "WASHING AND DRYING APPARATUS FOR GINSENG" can be given as an example to the drum and cylinder driers mentioned above. As it can be seen, the mentioned drier is designed only for drying a certain type of plant (ginseng).

In the state of the art; there is a patent document no UA106461 with the title "IR DRYER FOR DRYING ORGANIC RAW PLANT MATERIAL". In this drier; the drying process is carried out "only" by IR (Infrared) radiation. Moreover, the foodstuff to be dried is covered by a carbon heating film. The mentioned drier has a vertical cylindrical chamber with a cover on top. It is not possible for the foodstuff to have vitamin D in the driers which dry only by IR radiation. In the state of the art, IR radiation is widely used for the artificial drying processes. However, the taste, nutritious values and appearance of the natural drying cannot be achieved by artificial drying. In the natural drying process carried out under the sun; the foodstuff acquires vitamin D with the influence of the ultraviolet sunrays and is more delicious when compared to the artificially dried foodstuff. However, as mentioned above, natural drying has various disadvantages such as hygiene, time, labor, productivity, sustainability etc.

In the state of the art US2015020408 (A1) indicates a SOLAR ENERGY in a foodstuff drying application. According to the invention the solar energy is used " . . . to be heated by solar energy impinging on the enclosure . . . " and " . . . for drying or heating product within an enclosure using air heated by solar radiation . . . ". It is not possible to rotate or transfer UV rays by changing the rotation of the heated air. Due to the written explanations in the document it is not possible to suppose that it uses the UV ray for a drying process. Also, it must be accepted that the said invention does not involve any statement to serve as antibacterial effect and any vitamin D synthesis.

Also, in the state of the art US2005115099 (A1) discloses a system comprising a heated liquid passing through it. In the specification the invention discloses that the system is IR permeable but does not indicates the bacterial effect or vitamin synthesis due to this permeability. The invention uses heated liquid to dry the foodstuff.

Many scientific studies show that; exposure to sunrays has protective effect against many types of cancer (prostate cancer, breast cancer, colon cancer, ovary cancer and lymphoma etc. . . . ). It is beyond doubt here that the protective effect is attributable to UVB (ultraviolet rays with wavelength: 320-290 nanometers) radiation. UVB radiation causes vitamin D synthesis in the body and the sunrays provide about 80-90% of the vitamin D need for many people.

According to USA Diet Guide published in 2005; it is stated that older individuals, individuals with dark skin color and individuals who are insufficiently exposed to sunrays are required to take vitamin D with food and/or externally by food supplements.

Moreover; the organic structure of the foodstuff which influence the drying process, the moisture contents, the level of being affected by the temperature and the desired dryness are different from each other. Accordingly, different drying conditions are required for each product. In the state of the art; different processes and driers are developed for the same product. The quality of the process is evaluated according to the product drying quality and fuel consumption. For example, since the intensity and viscosity of paddy and other agricultural products differ, these cannot be dried in the same drier. In the state of the art; for example, paddy cannot be dried in a drier in which corn is dried.

THE PURPOSE AND SHORT DESCRIPTION OF THE INVENTION

The purpose of the invention is to produce a portable drier with solar simulator that can be used by small or medium scale farmers, which provides drying of the fruits and vegetables in general in the agriculture sector, in an organic manner through natural methods and as a result extension of their shelf life, and which, in order to protect human health, minimizes the chemical remnants that cause diseases. Moreover, the most important purpose of the invention is to combine the advantages of the natural drying and artificial drying. The taste and nutritious values of natural drying and hygienic and productive nature of artificial drying can be provided simultaneously in the drier with solar simulator. Thanks to the drier with solar simulator; the ideal conditions ("very hot, dry and slightly windy air") for drying process are provided in a portable drier with hygienic environment. Moreover, in the drier with solar simulator, the drying process is carried out with the controlled mix of infrared (IR) and ultraviolet (UV) rays. The parameters such as the amount, angles, intensities etc. of IR and UV rays are set specifically for each type of foodstuff. Mentioned settings are on the control computer as a module. This way, the user can select over the control computer (unit), the module (program) of the relevant product before the drying process and provide that the settings of the drier are appropriate for the product to be dried.

The water content evaporated (water vapor) from the structure of the foodstuff by IR and UV radiation is directed to a condensation area by a fan or fans. This way, a fan or fans provide that the ambient air in the drier remains at ideal dryness. The parameters such as speed, angle, operation time etc. of the mentioned fan or fans can be set separately for each product by the modules (programs) identified to the control computer (unit) in advance.

The main principle of the drier in the present invention is to provide a controlled contact of the products subjected to resonance on the trays, with infrared (IR) and ultraviolet (UV) rays and direction of the water vapor created on an aluminum condensation surface with the help of the fans and removal from the medium via liquid discharge channels.

In the drier with solar simulator; UV rays are used together with IR rays. Infrared (IR) rays and ultraviolet (UV) rays used for drying process in the drier with solar simulator in the present invention prevent the spoilage of the vitamins in the foodstuff. In the drier with solar simulator; UV rays with wavelength of 100 nm to 400 nm are used. Mentioned wavelength range includes the wavelength of UVB rays which provide vitamin D synthesis. In the drier with solar simulator, UV rays used together with IR rays in the drying process provide vitamin D synthesis in the dried foodstuff. This way; the people, who are required to get vitamin D from outside, can consume these dried foodstuff produced organically and adjust their levels of vitamin D.

In the drier in the present invention; different forms of drying are determined for each product by changing the proportions (programming) IR and UV rays as based on the type of the product to be dried. This way, different types of foodstuff can be dried by a single device under optimum conditions (by selecting the drying conditions appropriate for the relevant foodstuff over the computer program). As a result, a major advantage is provided when compared to the similar devices in the state of the art.

Moreover, thanks to the effect of UV (ultraviolet) rays which accelerate the chemical reactions; the foodstuff dried in the drier with solar simulators have the same aroma with the foodstuff dried naturally under the sun.

In the drier with solar simulators; there is a closed crying system. This way, following the drying process, the foodstuff dried can be packed at the desired dimensions or weight without any contact with air and manual contact.

The drier in the present invention is a portable device. This way, the fresh product can be dried at the location where it is picked.

The drier with solar simulator, simulates a "very hot, dry and slightly windy day" as the drying method. The type of the foodstuff to be dried is selected over the computer control panel and the drying process is carried out by the previously determined values. Moreover, these are devices that can directly be connected to the packing system.

In the drier with solar simulator; thanks to UV radiation; the microorganisms, bacteria and fungus which settle on the foodstuff at the stage of raising and which cause spoilage reactions such as enzymatic, non-enzymatic, oxidation reactions foodstuff, are eliminated. This way, the foodstuff dried in the drier with solar simulator can be stored after drying without any need for extra protective additives.

SHORT DESCRIPTIONS OF THE FIGURES

FIG. 1: The front view of the drier in the present invention

Figure 2:
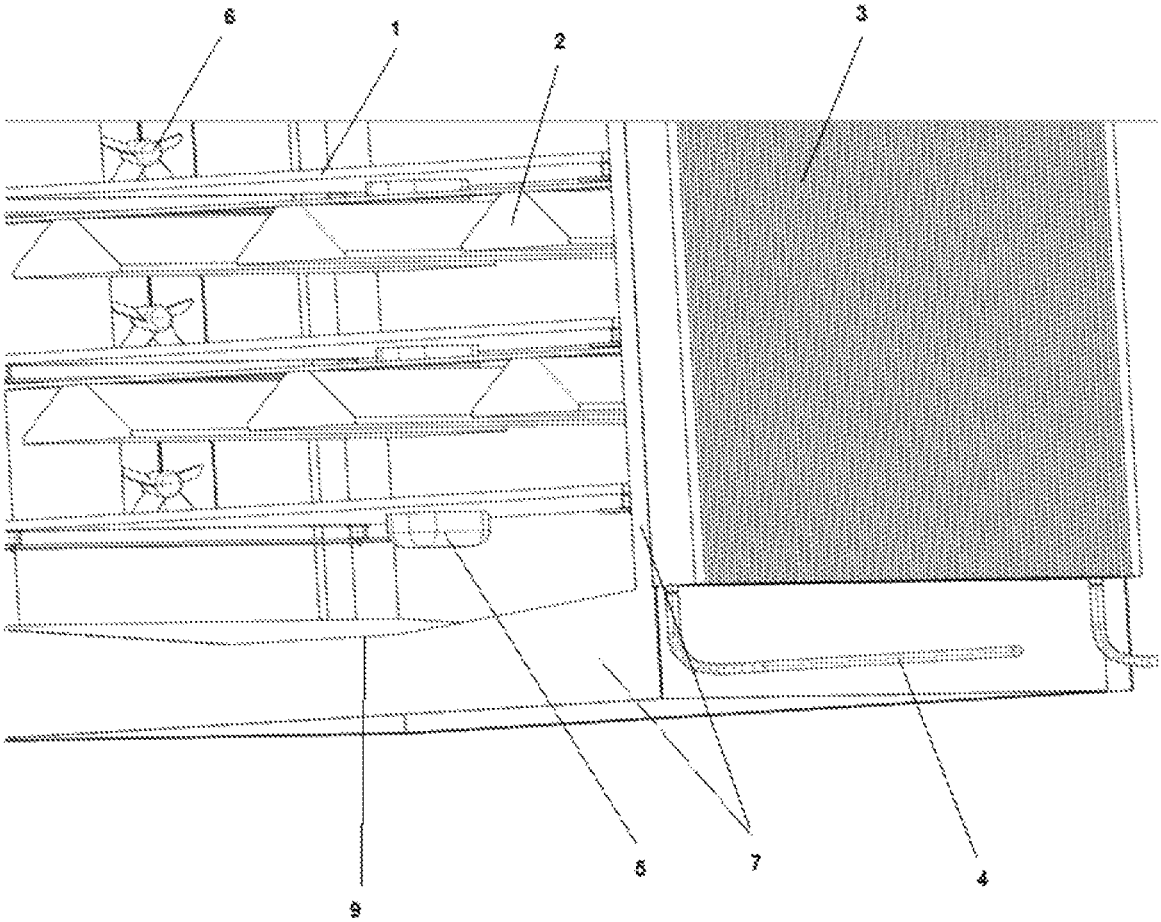

FIG. 2: The diagonal view of the drier in the present invention

LEGEND

| NO | NAME OF THE PART |
|---|---|
| 1 | Tray |
| 2 | IR - UV Slot |
| 3 | Aluminum Condensation Surface |
| 4 | Cooling Liquid Channel |
| 5 | Resonance Motor |
| 6 | Fan |
| 7 | Insulation Material |
| 8 | Liquid Discharge Channel |
| 9 | Product Discharge Section |

DETAILED EXPLANATION OF THE INVENTION

In the drier with solar simulator; there are trays (1) of which the dimensions and number may vary. The fresh products (fruits, vegetables) to be dried are placed on the mentioned trays (1). There are very small holes in the structure of the mentioned trays (1) which enable air flow to pass through.

In the drier with solar Simulator; there are IR-UV slots (2) (IR-UV sources) that provide the rays required for the drying process to be sent to the mentioned trays (1). The number of the mentioned IR-UV slots (2) vary as based on the dimensions of the trays (1). IR and UV rays mix is released from IR-UV slots (2). IR-UV rays mix is sent at the amount, duration and angle required by the drying process which is determined and selected over the computer panel. This way, the water and moisture content in the structure of the foodstuff, which is placed on the trays (1) are evaporated and removed.

The mentioned vapor is directed by the fans (6) on one side of the drier with solar simulator towards the aluminum condensation surface (3) on the other side. For an effective condensation, the mentioned aluminum condensation surface (3) is supported by the cooling liquid channels (4) through which cold water runs.

In the drier with solar simulator, all the surfaces, except the aluminum condensation surface (3), are covered by insulation material (7).

In order to turn the foodstuff during drying process; there are resonance motors (5) under each tray (l). Vibration can be given to the trays (1) at the desired duration and at the desired intensity by the mentioned resonance motors (5). The foodstuff on the tray (l) is also moved by this vibration. This way, the surface area on the foodstuff which is influenced by IR-UV rays is enlarged.

Following the termination of the drying process; the trays (1) are rotated by 10° to 90° (preferably 15°) by an arm or a motor connected to them. Upon rotation of the trays (1); the dried products are transferred to the product discharge section (9) located at the bottom part of the drier. The dried products are transferred to the packing unit from the mentioned product discharge section (9) via closed conveyor system. This way, dried products are packed and put out on market at the desired amounts and sizes without any manual contact.

As a model version of the invention, the food drying method in the drier with solar simulator is realized as follows:

The user places the fresh foodstuff (fruit, vegetable), which is desired to be dried, on the trays (1) of the drier with solar simulator. Then the user selects the (identified) drying process (program) from the computer control unit, which is appropriate for the foodstuff on the tray (l). Based on the drying program selected; the parameters such as angles of IR-UV slots (2), amounts of IR-UV rays, drying time, fan (6) speed and angle, vibration frequency of the resonance motor (5) etc. are adjusted optimally in compliance with the characteristics of the product on the tray (l).

The drying process is carried out by the IR-UV radiation given from the IR-UV slots (2). While the product on the tray (l) is exposed to IR-UV radiation, the resonance motors (5) provide the vibration of the tray (l). By the vibration of the tray (l), the surface of the product on the tray (l), which is exposed to IR-UV radiation is increased. Thanks to the micro holes on the trays (1), formation of the air flow on the surface of the foodstuff contacting the tray (l) is enabled.

The evaporation process of the water content in the fresh foodstuff, which is exposed to IR-UV radiation, starts. Moreover, vitamin D synthesis is started in the foodstuff, thanks to UV radiation.

Water vapor evaporated from the foodstuff is directed to the aluminum condensation surface (3) via the fan (6) or the fans (6). Water vapor arriving at the aluminum condensation surface (3) is condensed (becomes liquid again) and flows to the liquid discharge channel (8). There are cooling liquid channels (4) within the structure of the aluminum condensation surface (3). Condensation process is faster and more effective thanks to the cooling liquid flowing through the cooling liquid channels (4).

When the drying process is completed; the trays (1) are rotated for example by 45° by an arm or a motor. When the trays (1) are rotated; dried foodstuff falls into the product discharge section (9). The dried products are transferred to the packing unit from the mentioned product discharge section (9) by a closed conveyor system. This way, dried products are packed and put out on market at the desired amounts and sizes without any manual contact.

In addition; drying processes according to each foodstuff is programmed in the computer control unit of the drier with solar simulator. The user can select the settings according to each foodstuff, by a single selection.

The invention claimed is:

1. A method with solar simulator used in a drying process of foodstuff, comprising:

exposing fresh foodstuff laid on trays to IR-UV rays, wherein the IR-UV rays are at 100-400 nm which enables an elimination of microorganisms, bacteria, and fungus;

directing water vapor evaporated from the foodstuff exposed to IR-UV rays towards an aluminum condensation surface by one or more fans;

condensing water vapor at the aluminum condensation surface and flowing the condensed water vapor through a liquid discharge channel to a discharge;

lifting the trays by an arm or motor when the drying process is completed; and transferring a dried foodstuff to a product discharge section.

2. The of claim 1 further comprising vibrating the trays after exposure of the fresh foodstuff to enlarge the surface of the said foodstuff which is exposed to IR-UV rays during the drying process using at least one resonance motor.

3. The method of claim 1 further comprising, when the drying process is completed, vibrating the lifted tray and discharging the dried foodstuff from trays.

4. The method of claim 1 further comprising following the termination of the drying process rotating trays by 10°-90°, preferably 15°.

5. The method of claim 1 further comprising selection of process parameters prior to the drying process using a computerized control unit, the process parameters comprising angles of IR-UV slots, an amount of IR-UV rays, drying duration, fan speed and angle, vibration frequency of a resonance motor, which were adjusted optimally in compliance with the characteristics of the foodstuff through a module program installed in the computer.

6. The method of claim 5 further comprising a solar simulator which the user can select settings according to each foodstuff.

7. The method of claim 1 further comprising a solar simulator which the user can select settings according to each foodstuff.

8. A drier with solar simulator used in a drying process of foodstuff, comprising:

IR-UV slots for passing IR-UV rays, which provide a drying process and occurrence of vitamin D synthesis within the foodstuff placed on trays during the said drying process; and one or more fans for directing water vapor evaporated from the foodstuff exposed by IR-UV rays towards an aluminum condensation surface.

9. The drier with solar simulator of claim 8 wherein the trays comprise small holes so that air can flow through them.

10. The drier with solar simulator of claim 8 further comprising at least one resonance motor providing vibration to trays to enlarge a surface area of the foodstuff exposed to IR-UV rays.

11. The drier with solar simulator of claim 8 further comprising at least one aluminum condensation surface enabling water vapor which is removed from the said foodstuff exposed by IR and UV rays and directed by one or more fans to become liquid.

12. The drier with solar simulator of claim 11 further comprising cooling liquid channels to support condensation taking place on the aluminum condensation surface.

13. The drier with solar simulator of claim 11 further comprising a liquid discharge channel enabling discharge of water vapor which is liquidized on the aluminum condensation surface.

14. The drier with solar simulator of claim 8 further comprising a product discharge section that takes dried foodstuff from trays.

15. The drier with solar simulator of claim 14 further comprising a rotation mechanism or motor that provides a rotation of trays by 10° to 90° in order to transfer dried foodstuff to a product discharge section.

16. The drier with solar simulator of claim 8 further comprising a rotation mechanism or motor that provides a rotation of trays by 10° to 90° in order to transfer dried foodstuff to a product discharge section.

17. The drier with solar simulator of claim 8 wherein the IR-UV rays have a wavelength in the range of 100 nm to 400 nm.

18. The drier with solar simulator of claim 17 wherein the IR-UV rays comprise UVB rays, to cause vitamin D synthesis by a wavelength of 290-320 nm.

19. The drier with solar simulator of claim 8 wherein the IR-UV rays comprise UVB rays, to cause vitamin D synthesis by a wavelength of 290-320 nm.

20. The drier with solar simulator of claim 8 further comprising a computer control system which provides settings of drying parameters to be applied separately for each foodstuff item and a selection by a name of the product displayed on a computer screen based on the foodstuff.

* * * * *